US011268230B2

(12) United States Patent
Lee et al.

(10) Patent No.: US 11,268,230 B2
(45) Date of Patent: Mar. 8, 2022

(54) BALANCE WEIGHT MOUNTING STRUCTURE FOR WASHING MACHINE AND BALANCE WEIGHT MOUNTING DEVICE

(71) Applicant: LG ELECTRONICS INC., Seoul (KR)

(72) Inventors: Hyunseung Lee, Seoul (KR); Joongil Shin, Seoul (KR); Sanghee Yoo, Seoul (KR); Youngho Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 228 days.

(21) Appl. No.: 16/509,113

(22) Filed: Jul. 11, 2019

(65) Prior Publication Data

US 2020/0018008 A1 Jan. 16, 2020

(30) Foreign Application Priority Data

Jul. 12, 2018 (KR) ..... 10-2018-0080974

(51) Int. Cl.
*D06F 37/26* (2006.01)

(52) U.S. Cl.
CPC ..... *D06F 37/265* (2013.01); *D06F 37/261* (2013.01)

(58) Field of Classification Search
None
See application file for complete search history.

(56) References Cited

U.S. PATENT DOCUMENTS 4,519,223 A * 5/1985 Wasemann ..... D06F 37/12 68/23.5
2006/0174666 A1* 8/2006 Je ..... D06F 37/265 68/235 R
2013/0026895 A1* 1/2013 Gweon ..... D06F 37/265 312/228

FOREIGN PATENT DOCUMENTS

WO WO-2018155520 A1 * 8/2018 ..... D06F 37/12

* cited by examiner

*Primary Examiner* — Cristi J Tate-Sims
(74) *Attorney, Agent, or Firm* — Fish & Richardson P.C.

(57) ABSTRACT

A balance weight mounting structure of a washing machine and a balance weight mounting device are disclosed. The balance weight mounting structure of a washing machine comprises a cabinet; a tub movably supported with respect to the cabinet; a drum rotatably supported in the tub; and a balance weight provided in the tub, increasing a weight of the tub, wherein the tub and the balance weight are welded by a welding device and fixedly fastened to each other.

18 Claims, 4 Drawing Sheets

BALANCE WEIGHT MOUNTING STRUCTURE FOR WASHING MACHINE AND BALANCE WEIGHT MOUNTING DEVICE

CROSS-REFERENCE TO RELATED APPLICATIONS

This application claims the benefit of the Korean Patent Application No. 10-2018-0080974, filed on Jul. 12, 2018, which is hereby incorporated by reference as if fully set forth herein.

FIELD

The present disclosure relates to a balance weight mounting structure of a washing machine, and more particularly, to a balance weight mounting structure of a washing machine and a balance weight mounting device, in which a mounting process of a balance weight mounted in a tub may be simplified.

BACKGROUND

Generally, a washing machine is an appliance that washes laundry through washing, rinsing and dehydrating courses to remove various contaminants attached to clothes, bedding, etc. in a drum rotated by using an action between a detergent and washing water in a tub.

A drum washing machine according to the related art comprises a tub provided by a spring and a damper, and a drum provided inside the tub, washing laundry, and a balance weight provided on a front portion (or rear portion) of the tub, preventing weight imbalance of the tub from occurring.

In this case, the balance weight is provided with a housing generally forming an external appearance, made of a projectile of a plastic material to form a charging space therein and filled with heavyweight materials such as cement.

On the other hand, in a mounting structure of the balance weight provided in the drum washing machine according to the related art, a welding boss to which a fastening bolt is fixed is formed to protruded at one side of the front surface of the tub, and the balance weight is provided with a welding hole into which a fastening bolt is inserted, to correspond to the welding boss.

Also, a washer is additionally inserted and mounted between the fastening bolt and the balance weight to maintain a fastening power of the fastening bolt and also to prevent the balance weight from being voluntarily untied when the balance weight is fixed to the tub.

The balance weight mounting process of the drum washing machine according to the related art will be described as follows.

First of all, the balance weight is mounted to the front surface (or the rear surface) of the tub in a state that the welding boss formed in the tub is inserted into the welding hole of the balance weight.

In this case, a diameter and a length of the welding boss formed in the tub are generally smaller than those of the welding hole formed in the balance weight. Therefore, an end of the welding boss is exposed to the welding hole in a state that it is arranged to be lower than the welding hole. Afterwards, in a state that the fastening bolt is inserted into the washer, the fastening bolt is inserted and fixed to the welding boss of the balance weight.

Therefore, one side of the washer mounted in the fastening bolt is tightly adhered to one surface of the welding hole of the balance weight, and the other side is tightly adhered to the fastening bolt, whereby a fastening power between the balance weight and the tub is maintained and the balance weight is prevented from being voluntarily untied.

However, the balance weight mounting structure of the drum washing machine according to the related art described as above further needs additional fastening members such as a fastening bolt and a washer when the balance weight is fixed to the tub. For this reason, a problem occurs in that the number of processes required for fastening of the balance weight is increased.

Also, in case of the fastening bolt, the fastening power between the fastening bolt and the welding boss is deteriorated if a long time passes after the fastening bolt is fixed to the welding boss, whereby a problem occurs in that a fixed state of the balance weight may become poor by vibration (that is, vibration of the tub) of the washing machine.

SUMMARY

Accordingly, the present disclosure is directed to a balance weight mounting structure of a washing machine and a balance weight mounting device that substantially obviates one or more problems due to limitations and disadvantages of the related art.

An object of the present disclosure is to provide a balance weight mounting structure of a washing machine and a balance weight mounting device, in which a fastening structure of a balance weight fixed to a tub is improved.

Another object of the present disclosure is to provide a balance weight mounting structure of a washing machine and a balance weight mounting device, in which a fastening structure of a balance weight fixed to a tub is simplified to simplify a process required for fastening of the balance weight.

Still another object of the present disclosure is to provide a balance weight mounting structure of a washing machine and a balance weight mounting device, in which a fastening structure of a balance weight is rigidly fixed to a tub.

Further still another object of the present disclosure is to provide a balance weight mounting structure of a washing machine and a balance weight mounting device, in which a fastening structure of a balance weight is fixed to a tub without a separate fastening member.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a balance weight mounting structure of a washing machine according to one embodiment of the present disclosure comprises a cabinet; a tub movably supported with respect to the cabinet; a drum rotatably supported in the tub; and a balance weight provided in the tub, increasing a weight of the tub, wherein the tub and the balance weight are welded by a welding device and fixedly fastened to each other.

Preferably, the tub is provided with a welding boss, which is inserted into the balance weight and welded, on a front portion, and the balance weight is provided with a welding hole into which the welding boss is inserted.

Preferably, the welding boss is provided with a welding rib protruded from the front portion of the tub, forming an insertion hole at the center, and the welding hole is formed in a shape corresponding to an outer circumferential surface of the welding rib to form a step difference portion where an end portion of the welding rib is welded.

Preferably, at least one or more welding protrusions are further formed in the step difference portion to weld the welding rib.

Preferably, the step difference portion is formed to form a step difference shape recessed from a surface of the balance weight.

Preferably, the welding boss is provided with a mounting portion formed at a lower end to be inclined in a direction extended from the center of the welding boss, and the welding hole is provided with a mounting surface formed at a lower end to correspond to the mounting portion.

In another aspect of the present disclosure, in a balance weight mounting device for mounting a balance weight to a tub provided with a welding boss on a front portion, the balance weight being provided with a welding hole, into which a welding boss is inserted, and being fixed to the front portion of the tub, the welding boss is provided with a welding rib protruded from the front portion of the tub, forming an insertion hole at the center, and the welding hole is formed in a shape corresponding to an outer circumferential surface of the welding rib to form a step difference portion where an end portion of the welding rib is welded, and the balance weight mounting device comprises a vibration generator; and a welding horn for welding the welding rib to the step difference portion by melting the welding rib in accordance with vibration of the vibration generator, the welding horn including an insertion protrusion inserted into the insertion hole, melting the welding rib, and a pressurizing groove formed on an outer circumferential surface of the insertion protrusion, pressurizing an end of the welding rib to weld the welding rib to the step difference portion.

According to the balance weight mounting structure of a washing machine and a balance weight mounting device of the present disclosure, a fastening structure of the balance weight fixed to the tub is improved to simplify a fastening structure of the balance weight fixed to the tub, whereby a process required for fastening of the balance weight may be simplified.

Also, according to the balance weight mounting structure of a washing machine and a balance weight mounting device of the present disclosure, the balance weight may be fixed to the tub more rigidly.

Also, according to the balance weight mounting structure of a washing machine and a balance weight mounting device, the balance weight may be fixed to the tub without a separate fastening member.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Hereinafter, a balance weight mounting structure of a washing machine and a balance weight mounting device according to one embodiment of the present disclosure will be described in detail with reference to the accompanying drawings.

Titles of elements defined in description of the present disclosure are defined in consideration of their functions in the present disclosure. Therefore, the titles of elements should not be understood to restrict technical elements of the present disclosure. Also, the titles defined in the respective elements may be referred to as other titles in the art to which the present disclosure pertains.

Therefore, the present disclosure is not limited to the following embodiments, and various modifications and corrections may be made in the embodiments of the present disclosure by persons skilled in the art to which the present disclosure pertains within the scope of the present disclosure.

First of all, a washing machine according to one embodiment of the present disclosure will briefly be described with reference to the accompanying drawings. For convenience of description, a detailed description of the same elements as those of the related art will be omitted, and only a portion related to the present disclosure will be described in detail.

Figure 1:
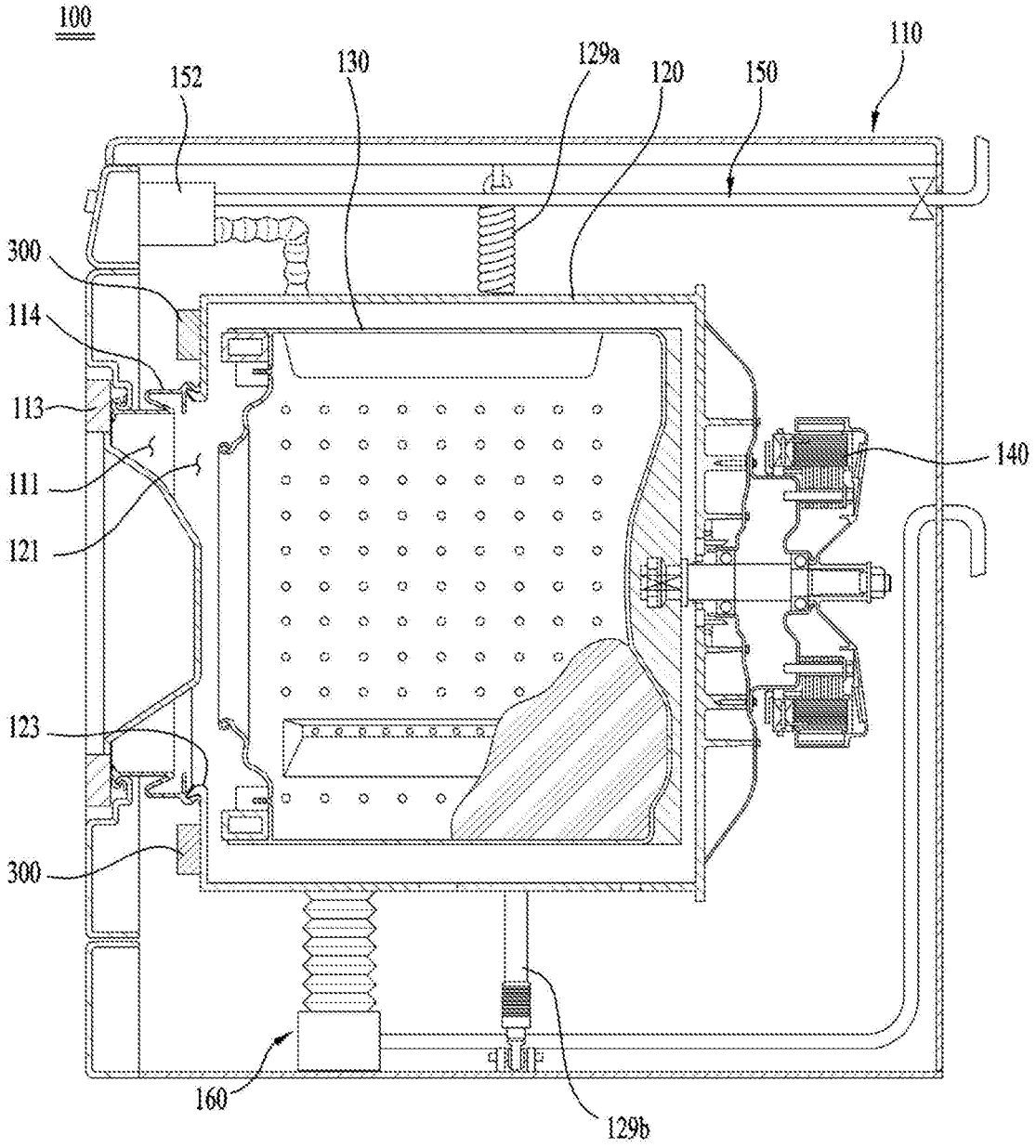
FIG. 1 is a brief view illustrating a washing machine according to one embodiment of the present disclosure.
Figure 2:
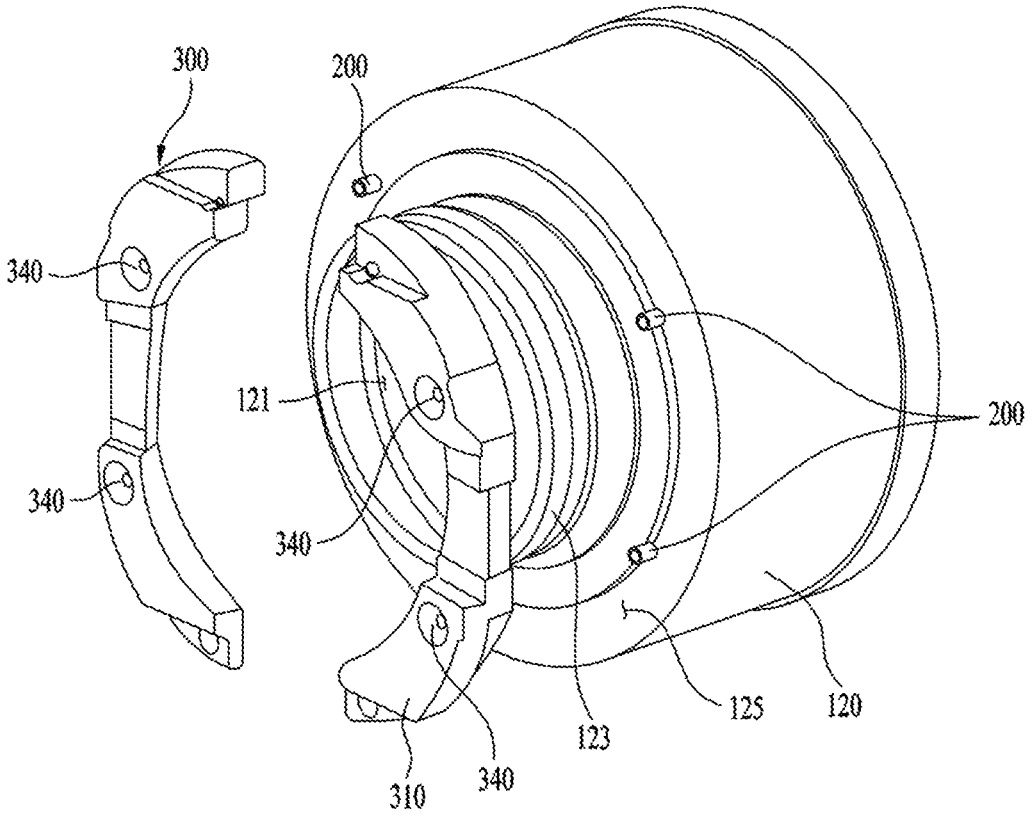
FIG. 2 is an exploded perspective view illustrating a balance weight and a tub of a washing machine according to one embodiment of the present disclosure.

FIG. 1 is a brief view illustrating a washing machine according to one embodiment of the present disclosure, and FIG. 2 is an exploded perspective view illustrating a balance weight and a tub of a washing machine according to one embodiment of the present disclosure.

As shown in FIG. 1, the washing machine according to one embodiment of the present disclosure comprises a cabinet 110 forming an external appearance of the washing machine 100 and constituting respective elements constituting the washing machine 100, provided with an insertion hole 111 for inserting laundry, a tub 120 movably supported inside the cabinet 110 by a separate suspension (for example, damper 129*b* and spring 29*a*), in which washing water stored, a drum provided rotatably with respect to the tub 120 inside the tub 120, performing washing/rinsing/dehydrating/drying strokes by insertion of laundry, a driving motor 140 rotating the drum by transferring a rotational force to the drum, a water supply portion 150 for supplying washing water to the tub 120, a drainage portion 160 for draining washing water supplied to the tub 120 to complete the washing/rinsing strokes and washing water discharged from the laundry during the dehydrating stroke, a gasket 114 provided between the insertion hole 111 of the cabinet 110 and the tub 120 to maintain water tight, and a balance weight 300 provided in the tub 120 to attenuate the amount of vibration of the tub 120 by increasing a weight of the tub 120.

In this case, the same/similar configuration as/to that of the general washing machine may be applied to the cabinet 110, the tub 120, the drum 130, the driving motor 140, the water supply portion 150 and the drainage portion 160. Therefore, a detailed description of the respective elements will be omitted, and the configuration related to the tub 120 and the balance weight 300, which are main elements of the present disclosure, will be described in detail. However, the embodiment of the present disclosure is not limited to the present disclosure, and may be applied to a washing machine that uses the fastening structure of the balance weight 300 of the present disclosure.

Meanwhile, as shown in FIG. 2, at least one or more balance weights 300 are fixed to the front of the tub 120. In this case, the balance weight 300 may selectively be provided at the front or the rear of the tub 120, and the front of the tub 120 and the rear of the tub 120 may be provided in their respective weights, shapes and arrangements different from each other.

The present disclosure relates to the mounting structure of the balance weight, and a detailed description of a detailed structure of the balance weight will be omitted, and a mounting related structure of the tub and the balance weight will be described in detail.

Meanwhile, an opening 121 forming a space into which laundry is inserted is formed at the front of the tub 120, and an opening rim 123 protruded toward the insertion hole 111 and coupled with the other end of the gasket 114 is formed on an inner circumferential surface of the opening 121. The opening rim 123 is extended toward the front of the tub on the inner circumferential surface of the opening 121 of the tub 120 and formed in a shape bent toward a direction extended from the opening 121.

The opening 121 formed in the tub 120 is more downsized than the front surface of the tub 120, and a ring shaped front portion 125 forming the front surface of the tub 120 is formed between an outer circumference of the opening 121 and an inner circumference of the tub 120. The front portion 125 is provided with a welding boss 200 to which the balance weight 300 is fixed.

Also, the balance weight 300 may be divided into at least one or more pieces and then mounted in the ring shaped front portion 12 in a shape corresponding to the shape of the front portion 125 formed in the tub 120. That is, the balance weight 300 may be formed in a ring shape or an arc shape corresponding to the shape (that is, outer side of the opening rim 123 formed in the opening 121 and inner side of the outer circumferential surface of the tub 120) of the front portion 125 formed on the front surface of the tub 120.

If the balance weight 300 is provided on the front surface of the tub 120, the balance weight may be divided into two pieces symmetrical to each other for left and right balance and then mounted in the front surface of the tub 120. Also, a specific shaped groove may further be formed to avoid interference with elements (for example, air supply portion (not shown) and washing water supply portion (not shown) formed on the front surface of the tub 120.

Hereinafter, the mounting structure of the balance weight 300 and the tub 120 will be described in detail with reference to FIG. 3.

Figure 3:
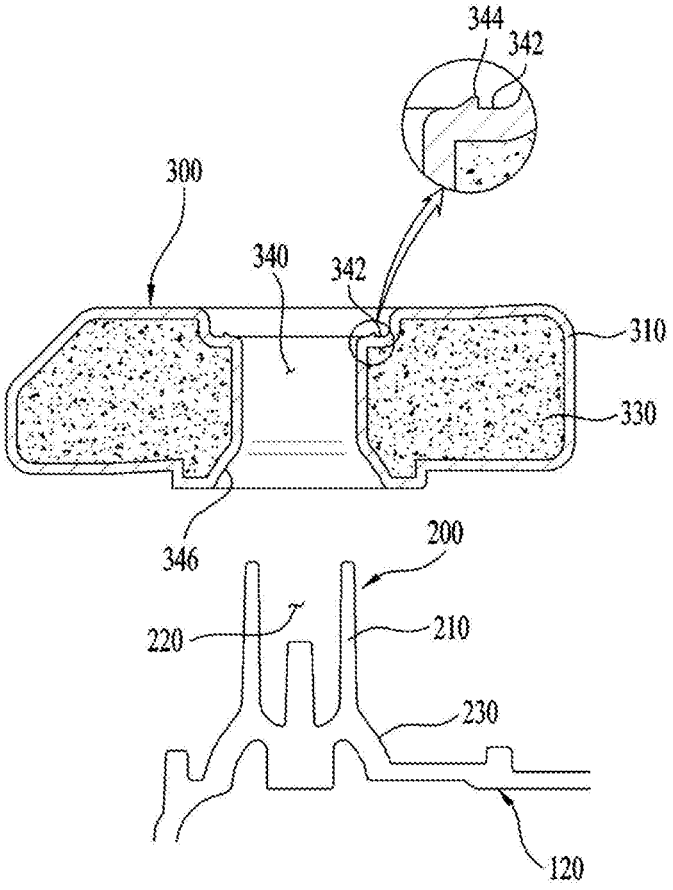
FIG. 3 is a cross-sectional view illustrating a fastening structure of a balance weight and a tub according to one embodiment of the present disclosure.

FIG. 3 is a cross-sectional view illustrating a fastening structure of a balance weight and a tub according to one embodiment of the present disclosure.

First of all, a plurality of welding bosses 200 setting a mounting position of the balance weight, welded to the balance weight 300 to fix the balance weight are formed on the front portion 125 of the tub 120. The welding bosses 200 are made of the same material as that of the tub 120 and formed in a single body with the tub 120.

The welding boss 200 is provided with an insertion hole 220 into which a welding horn 410 (see FIG. 4B of an ultrasonic welding device (not shown), which will be described later, is inserted, at the center of one side, and the insertion hole 220 is formed by a welding rib 210 melted by the welding horn 410. A mounting portion 230 for restricting the mounting position of the balance weight 300 is formed at an outer side (that is, connecting portion connected with the tub) of the other end of the welding boss 200.

Preferably, an outer circumferential surface of the welding boss 200 is formed in a conical shape to be tightly adhered and inserted into the welding hole 340 of the balance weight 300, wherein an end portion of the outer circumferential surface has a diameter smaller than that of the other end portion where the mounting portion 230 is formed.

The outer circumferential shape of the welding boss 200 may allow the mounting position of the balance weight 300 to be exactly arranged when the balance weight 300 is mounted in the tub 120 and at the same time may improve the fastening state by ultrasonic welding, which will be described later, by tightly adhering the outer circumferential surface of the welding boss 200 to the inner circumferential surface of the welding hole 340.

Preferably, the welding rib 210 becomes relatively thinner toward an end to perform fast melting by the welding horn 410 of the ultrasonic welding device, and the end of the welding rib 210 is formed in a triangular shaped section (that is, welding mountain) so as to be earlier melted in the welding horn 410 of the ultrasonic welding device.

Also, the mounting portion 230 may be formed in a conical shape or a circular shape, of which diameter is enlarged, as it is extended from the outside of the welding boss 200 to the tub 120. Therefore, the welding hole 340 of the balance weight 300, into which the welding boss 200 is inserted, may move to a direction where the center of the welding boss 200 is matched with the center of the welding hole 340 by the shape of the mounting portion 230.

As a result, it is preferable that an inner circumferential shape of the welding hole 340 of the balance weight 300 and an outer circumferential shape of the welding boss 200 of the tub 120 are formed to correspond to each other, whereby an available space is minimized during ultrasonic welding of the welding boss 200.

The balance weight 300 includes a case 310 forming an external appearance of the balance weight 300 and at the same time having a space therein, and a weight member 330 injected into the case 310 through an injection hole (not shown) formed in the case 310 and then hardened by being fully filled in the case 310 to serve as a heavyweight body of the balance weight.

The case 310 is adhered to the welding boss 200 formed in the tub 120 by ultrasonic welding, and is preferably formed of the same material as that forms the tub 120 and the welding boss 200 or another material that may be welded with the welding boss 200 of the tub 120.

Meanwhile, the case 310 is a projectile molded of a plastic material, and is provided with an inner space for charging the weight member 300. The injection hole (not shown) communicated with the inner space charged with the weight member 300, for injecting the weight member 330 into the inner space is formed at one side outside the case 310, and the case 310 is provided with a plurality of welding holes 340 formed at a position corresponding to the welding boss 200 partitioned from the inner space and formed on the front portion 125 of the tub 120.

In this case, the injection hole may be formed at various positions depending on a shape of the case 310 and an injection direction of the weight member 330, and may be communicated with the inner space of the case 310 to allow the weight member 330 to be injected into the inner space. Also, a portion of the injection hole may be formed to be protruded or recessed on the surface of the case 310 to avoid interference with the element provided at the front of the tub 120.

The welding hole 340 is formed to pass through the case 310 so as not to be communicated with the inner space into which the weight member 330 is inserted, and is formed to correspond to a position of a plurality of welding bosses formed in the tub.

Meanwhile, the welding hole 340 is formed to correspond to the position of the welding boss 200 formed on the front portion of the tub 120 in parallel with a direction where the balance weight 300 is fixed to the tub 120. Therefore, the balance weight 300 is mounted on the front portion of the tub 120 while moving in parallel with the welding boss 200, and the welding boss 200 of the tub 120 is inserted into the welding hole 340 of the balance weight 300.

In this case, the welding hole 340 is formed to pass through the case 310 of the balance weight 300 and at the same time is formed to be partitioned from the inner space of the case 310. That is, the welding hole 340 is not formed to simply pass through the case 310 of the balance weight 300 but formed such that the case 310 partially passes through the balance weight 300 when the case 310 of the balance weight 300 forms the space charged with the weight member 330.

Meanwhile, the inner circumferential surface of the welding hole 340 is formed in a conical shape of which sectional area is shortened in a direction where the welding boss 200 is inserted, so as to correspond to the outer circumferential surface of the welding boss 200, whereby the inner circumferential surface of the welding hole 340 is formed in a shape corresponding to the circumferential shape of the welding boss 200 so that the balance weight 300 may be tightly adhered to the outer circumferential surface of the welding boss 200 when the balance weight 300 is mounted on the front portion 125 of the tub 120.

A step difference portion 342 where the welding rib 210 of the welding boss 200 is welded is formed at an end portion outside the welding hole 340. The step difference portion 342 forms a space where the welding boss 200 is melted by the ultrasonic welding device and may be welded to the balance weight 300.

The step difference portion 342 is formed to be recessed from the surface of the case 310 of the balance weight 300 and at the same time enlarged from the diameter of the welding hole 340 to prevent the welding rib 210 of the welding boss 200 from being protruded to the outer side of the case 310 when the welding boss 200 is welded.

Also, the step difference portion 342 may be provided with one or more welding protrusions 344 formed to adjoin the welding hole 340. The welding protrusions 344 formed in the step difference portion 342 may be formed such that the welding rib 210 melted during welding of the welding boss 200 may be welded to the surface (that is, upper surface of the step difference portion 342) of the case 310 more easily.

The welding protrusions 344 may be formed in a ring shape to be overlapped around the center of the welding hole 340, and each of the welding protrusions 344 is preferably formed to have a triangular section. More preferably, the welding protrusion 344 having a triangular section is formed in an asymmetrical shape inclined toward an outer direction of the welding hole 340.

Meanwhile, in order to fix the balance weight 300 to the tub 120, an ultrasonic welding device (not shown) for melting and pressurizing the welding boss 200 of the tub 120 by ultrasonic welding to weld the welding boss 200 to the welding hole of the balance weight is provided.

In this case, an ultrasonic welding device typically used may be used as the ultrasonic welding device. Therefore, a configuration description of the ultrasonic welding device will be omitted, and the welding horn 410 for welding the welding boss of the present disclosure will be described.

Figure 4A:
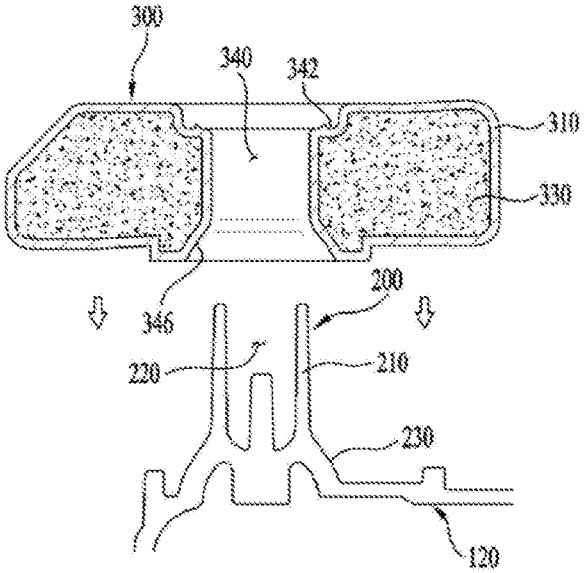
FIGS. 4A to 4C are brief views illustrating a mounting process of a balance weight according to one embodiment of the present disclosure.
Figure 4B:
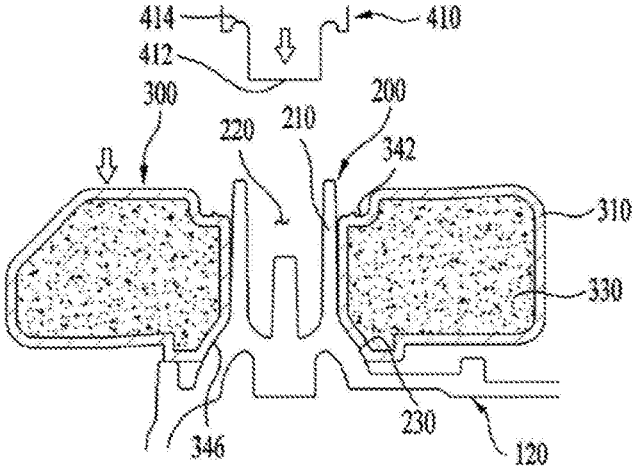

The welding horn 410 of the ultrasonic welding device is provided with an insertion protrusion 412 (see FIG. 4B inserted into the insertion hole 220 formed at the center of the welding boss 200 and frictionized with an inner circumferential surface of the insertion hole 220, and a pressurizing groove 414 (see FIG. 4B formed on an outer circumferential surface of the insertion protrusion 412, pressurizing the welding rib 210 melted by the welding horn 410 to weld the welding rib 210 to the step difference portion 342 of the welding hole 340.

In this case, the insertion protrusion 412 is inserted into the insertion hole 220 of the welding boss 200 to guide the position of the welding horn 410 and at the same time melt the welding rib 210 by contact with the inner circumferential surface (that is, inner side of the welding rib 210) of the insertion hole 220 of the welding boss 200.

Also, the pressurizing groove 414 is provided with a groove formed to be extended to the outer circumferential surface of the insertion protrusion 412 in a ring shape and recessed toward an inner side. The pressurizing groove 414 adjoins an end of the welding rib 210 in accordance with an operation of a vibration generator (not shown) of the ultrasonic welding device to melt the end of the welding rib 210, wherein the melted end of the welding rib 210 is pressurized by the pressurizing groove 414 and welded to the step difference portion 342 of the welding hole 340 of the balance weight 300. At this time, the end of the welding rib 210 which is melted and pressurized is formed along the shape of the pressurizing groove 414 of the welding horn 410.

Therefore, the balance weight mounting of the washing machine according to one embodiment of the present disclosure will be described in detail through the embodiment. Hereinafter, the respective elements mentioned below should be understood with reference to the aforementioned description and drawings.

Figure 4C:
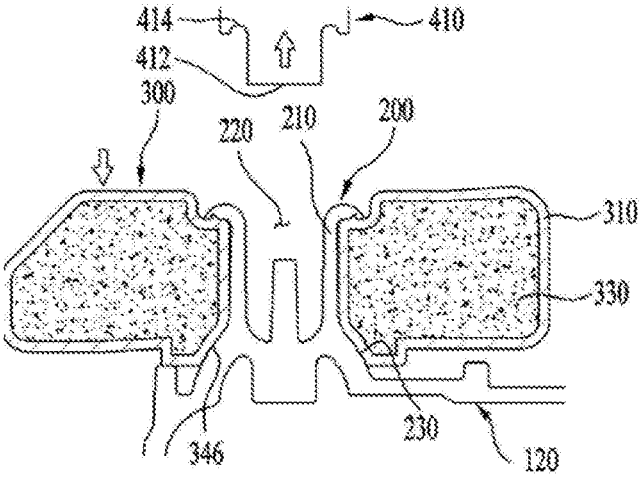

FIGS. 4A to 4C are brief views illustrating a mounting process of a balance weight according to one embodiment of the present disclosure.

First of all, as shown in FIG. 4A, after the welding hole 340 of the balance weight 300 and the welding boss 200 of the tub 120 move to the same shaft, the balance weight 300 moves to the front portion 125 of the tub 120 and at the same time the welding boss 200 is inserted into the welding hole 340.

In this case, the welding boss 200 of the tub 120 is provided with the mounting portion 230 that restricts a mounting position of the welding hole 340, and the welding hole 340 of the balance weight 300 is provided with a mounting surface 346 formed in a shape corresponding to the mounting portion. In a state that the welding hole 340 and the welding boss 200 are maintained at the same shaft by the mounting portion 230 and the mounting surface, the balance weight 300 may be mounted on the front portion 125 of the tub 120.

Afterwards, as shown in FIG. 4B, the welding horn 410 of the ultrasonic welding device is inserted into the insertion hole 220 of the welding boss 200. In this case, the insertion protrusion 412 of the welding horn 410 of the ultrasonic welding device is pressurized and inserted into the insertion hole 220 of the welding boss 200 in a state that it is tightly adhered to the inner circumferential surface of the insertion hole 220, and the pressurizing groove 414 of the welding horn 410 maintains a state adjoining the end portion of the welding rib 210 of the welding boss 200. This state of FIG. 4B is an initial state for welding the welding boss 200 and the welding hole 340, and in a state that the ultrasonic welding device pressurizes the welding rib 210 of the welding boss 200, the vibration generator of the ultrasonic welding device starts to operate, and the welding horn 410 is vibrated in accordance with the operation of the vibration generator and the welding boss 200 is melted.

At this time, the insertion protrusion 412 of the welding horn 410 is in contact with the inner circumferential surface of the insertion hole 220 of the welding boss 200 to melt the inner circumferential surface (that is, the inner circumferential surface of the welding rib 210) of the insertion hole 220, and the pressurizing groove 414 of the welding horn 410 melts the end of the welding rib 210 of the welding boss 200.

Afterwards, as shown in FIG. 4C, the end portion of the welding rib 210 of the welding boss 200 is melted by the pressurizing force pressurized by the ultrasonic welding device and welded to the step difference portion 342 formed at the end portion of the welding hole 340 of the balance weight 300.

At this time, one surface of the step difference portion 342 or the welding protrusion 344 formed in the step difference portion 342 is melted by melting heat of the welding rib 210 welded to the step difference portion 342, and the welding boss 200 and the balance weight 300 are welded to each other.

Afterwards, the ultrasonic welding device completes welding of the welding boss 200 of the tub 120 and the welding hole 340 of the balance weight 300 as the welding horn 410 is detached in a direction opposite to insertion to the welding boss 200.

Therefore, the fastening structure of the balance weight 300 fixed to the tub 120 may be improved to be simplified to simplify the process required for fastening of the balance weight 300, and at the same time the balance weight 300 may be fixed to the tub 120 more rigidly without a separate fastening member.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A washing machine comprising:

a cabinet;

a tub movably disposed in the cabinet;

a drum rotatably disposed in the tub;

a balance weight positioned at the tub to thereby add a weight to the tub;

a plurality of welding bosses that protrude in a forward direction away from the tub and are inserted into the balance weight, wherein the balance weight defines a plurality of welding holes, each of the plurality of welding holes receiving one of the plurality of welding bosses, wherein a welding boss among the plurality of welding bosses comprises a welding rib that protrudes from the tub, the welding rib defining an insertion hole at a center area of the welding rib, wherein the balance weight further defines a step difference portion recessed radially outward from an inner surface that defines a welding hole among the plurality of welding holes, a diameter of the step difference portion being greater than a diameter of the welding hole, and wherein an end of the welding rib extends to an outside of the welding hole and is welded to the step difference portion.

2. The washing machine of claim 1, wherein the welding hole has a shape corresponding to an outer circumferential surface of the welding rib.

3. The washing machine of claim 2, wherein the balance weight further comprises one or more welding protrusions that are disposed at the step difference portion and that are configured to be welded to the welding rib.

4. The washing machine of claim 2, wherein the step difference portion is recessed from a front surface of the balance weight.

5. The washing machine of claim 1, wherein the welding boss comprises a mounting portion that is disposed at a portion facing a front surface of the tub, that is inclined with respect to the front surface of the tub, and that extends in a direction radially outward from a center of the welding boss, and wherein the balance weight comprises a mounting surface disposed at an end of the welding hole and configured to face the mounting portion of the welding boss.

6. The washing machine of claim 1, wherein the balance weight comprises a case that is made of a plastic material and that defines an inner space, and a weight member that is filled in the inner space of the case.

7. The washing machine of claim 1, wherein the plurality of welding bosses protrude forward relative to a front surface of the tub.

8. The washing machine of claim 1, wherein the plurality of welding bosses are symmetrically arranged at a front surface of the tub with respect to a vertical plane passing a center of the tub.

9. The washing machine of claim 1, wherein the balance weight has a first surface facing a front surface of the tub and a second surface facing the cabinet, and wherein a thickness of the balance weight between the first surface and the second surface at a periphery of the welding hole is less than a protrusion length of the welding boss.

10. The washing machine of claim 1, wherein at least a portion of the welding boss protrudes forward of a front surface of the balance weight based on the welding boss being received in the welding hole.

11. The washing machine of claim 1, wherein the welding boss has a conical shapes or a cylindrical shape.

12. The washing machine of claim 2, wherein the welding boss further comprises a protrusion that is disposed inside of the insertion hole, that is spaced apart from the welding rib, and that is surrounded by the welding rib.

13. The washing machine of claim 3, wherein the welding protrusions have a ring shape that protrudes from a front surface of the balance weight.

14. The washing machine of claim 13, wherein a cross section of the welding protrusions has an asymmetric triangular shape.

15. The washing machine of claim 14, wherein the welding protrusions have a surface that extends from a circumferential surface of the welding hole in a direction radially outward from the circumferential surface of the welding hole.

16. The washing machine of claim 1, wherein the end of the welding rib extends radially and axially outside the welding hole.

17. The washing machine of claim 1, wherein the welding rib extends forward through the balance weight and is curved radially outside the welding hole to thereby cover a boundary between the welding hole and the step difference portion.

18. The washing machine of claim 1, wherein an inner circumferential surface of the welding rib is in contact with the insertion hole.

* * * * *